United States Patent [19]

Havlik

[11] Patent Number: 4,790,910

[45] Date of Patent: Dec. 13, 1988

[54] APPARATUS FOR EXTRACTING HYDROCARBONS FROM TAR SANDS

[76] Inventor: Jaroslav J. Havlik, 311 Montrose Street, Cambridge, Ontario, Canada, N3H 5C6

[21] Appl. No.: 118,735

[22] Filed: Nov. 9, 1987

[30] Foreign Application Priority Data

Aug. 13, 1987 [CA] Canada ..... 544,485

[51] Int. Cl.[4] ..... C10B 53/06; C10G 1/02

[52] U.S. Cl. ..... 196/112; 196/121; 196/135; 201/8; 201/19; 201/26; 201/30; 201/32; 202/117; 202/136; 202/218; 202/262; 208/402; 208/407

[58] Field of Search ..... 196/98, 102, 112, 121, 196/135, 136; 202/136, 218, 117, 216, 131, 100, 262; 208/402, 407; 201/8, 19, 26, 30, 32

[56] References Cited

U.S. PATENT DOCUMENTS

| | | | |
|---|---|---|---|
| 1,724,982 | 8/1929 | Trumble | 196/112 |
| 1,765,702 | 6/1930 | Roser | 202/218 |
| 2,640,019 | 5/1953 | Berg | 208/402 |
| 3,377,266 | 4/1968 | Salnikov | 208/402 |
| 3,849,332 | 11/1974 | Bailey et al. | 201/19 |
| 4,187,167 | 2/1980 | Havlik et al. | 208/401 |
| 4,280,892 | 7/1981 | Havlik | 208/426 |
| 4,376,033 | 3/1983 | Calderon | 208/402 |
| 4,389,283 | 6/1983 | Calderon | 201/32 |

*Primary Examiner*—Wilbur Bascomb

*Attorney, Agent, or Firm*—Riches, McKenzie & Herbert

[57] ABSTRACT

An apparatus and method for extracting hydrocarbons from tar sands. Stationary heater plates have a central opening therethrough through which a horizontal axle extends. Rotors having a central hub and a number of arms are splined on the axle, one closely sandwiched between every two heater plates. A ring is provided between the heater plates closely outward of the rotor arms. Sand retaining pockets are defined between adjacent arms of each rotor, the rotor hub, the ring and adjacent heater plates. Sand is retained in the sand retaining pockets for about one revolution about the axis between feed and removal positions. While retained in the pockets, the sand is heated and hydrocarbons driven off are collected.

19 Claims, 5 Drawing Sheets

24
101
100
104
108
98
94
108
106
26
102
32
81
98
34
34
60
34
60
58
34

APPARATUS FOR EXTRACTING HYDROCARBONS FROM TAR SANDS

SCOPE OF THE INVENTION

This invention relates to an apparatus and method for the separation of hydrocarbons from oil bearing solids and more particularly to a rotary apparatus for electrically heating tar sands to extract as vapours and liquids hydrocarbons from tar sands and shales.

BACKGROUND OF THE INVENTION

U.S. Pat. Nos. 4,187,167 and particularly 4,280,892 to J. J. Havlik, describe apparatus and methods for the separation of crude petroleum from tar sands and the like. The present invention, by the same inventor, provides an improvement in these apparatus and methods. Both these prior patents provide mechanical devices for the heat treatment of tar sands. After experimentation, it has been found that the devices each suffer a number of disadvantages in transporting the tar and materials through heated zones. These disadvantages include preventing jamming of the apparatus with the tar sands, providing for controlled feeding and withdrawl of the tar sands through the apparatus, maintaining desired heating of the tar sands, and providing an apparatus which can readily be expanded to meet increased flow rates.

SUMMARY OF THE INVENTION

To at least partially overcome these disadvantages, the present invention provides a heater-extractor apparatus having a number of rotors rotatable about a horizontal axis, each rotor sandwiched between two heater plates whereby tar sand material is retained within pocket-like segments of the rotor defined between adjacent rotor arms and is rotated in close contact with the heater plates about the axis from a feed position to a removal position, with hydrocarbon gases and liquids, liberated by the heating rising upwardly from the rotor or dripping downwardly therefrom to be collected.

An object of this invention is to provide an apparatus and method for the separation of bitumen crude petroleum of such natural earth substances as tar sands and shale rock and other solid oil bearing materials through destructive distillation, thermal cracking and the collection of vapours and liquids so produced, preferably as multiple fractionated hydrocarbons.

Another object of the invention is to provide an apparatus and method for separating, recovering and collecting voatile substances from solids such as hydrocarbons from tar sands and the like with significantly less expenditure of energy than presently known apparatus and methods.

Another object is to provide an apparatus for extracting hydrocarbons from tar sands and the like which is mechanically simple and facilitates manufacture, operation and maintenance.

Accordingly, in one of its aspects the present invention provides a method of extracting hydrocarbons from tar sand materials. The method involves optionally crushing the feed tar sand materials to a particulate form of at least sand-size, optionally pre-heating the feed materials, passing the feed materials between vertical heater plates by entrapping the materials betweeh adjacent arms of rotors sandwiched between adjacent heater plates and rotatable about a horizontal axis, sufficiently heating the materials during their passage between the heater plates to drive-off hydrocarbon vapours and liquids, and collecting the vapours and liquids.

BRIEF DESCRIPTION OF THE DRAWINGS

These and other objects and advantages of the present invention will appear from the following description of the invention taken together with the accompanying drawings in which.

DETAILED DESCRIPTION OF THE DRAWINGS

Figure 1:
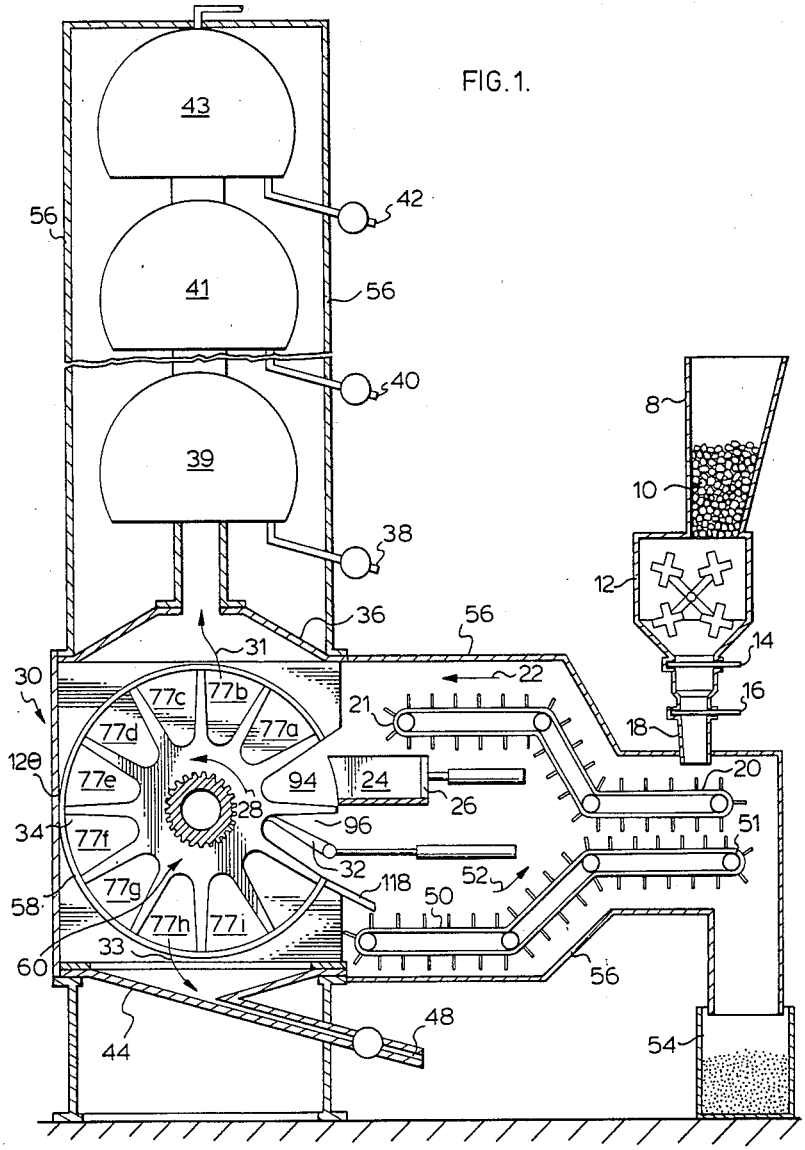
FIG. 1 is a schematic cross-sectional view of an apparatus in accordance with a preferred embodiment of the present invention illustrating principal elements thereof.

Reference is made first to FIG. 1, which illustrates diagrammatically the several elements of a preferred embodiment of an apparatus in accordance with the present invention.

A hopper 8 is shown which holds a supply of the materials 10 to be processed. Throughout the disclosure, the term "materials" will now be used to describe the tar sands, tar shales and the like materials from which vapours and liquids, generally hydrocarbons are desired to be extracted. Generally, the materials will be referred to as "feed materials" prior to extraction and "waste materials" after extraction.

Hopper 8 feeds the feed materials 10 into a chopper 12 wherein the feed materials are broken up into a particulate size, preferably comparable to the physical size of sand particles and delivered to a storage bin therebelow. The storage bin may be closed at the top by an upper gate 14 and at the bottom by a lower gate 16. The lower end of the bin has a chute 18 which projects onto the top of a feed conveyor 20 moving in a direction indicated by arrow 22. Feed conveyor 20 has a discharge end 21 which drops the feed materials into a feed bin 24. A feed ram 26 periodically feeds the materials into the heater plate and rotor assembly generally indicated 30, in which rotors 60 rotate in the direction of arrow 28 carrying the materials between stationary heater plates 34 to heat the materials so that their hydrocarbon content is driven off. The materials are subsequently removed from assembly 30 by scraper 32. During the period of time the materials are within assembly 30, they are sufficiently heated by heater plates 34 to extract substantial quantities of their hydrocarbons therefrom either as vapours which rise or liquids which descend for collection.

Vapours illustrated by arrow 31 which rise from assembly 30 are directed by upper funnel-like collector plates 36 into a plurality of condensors, three of which are schematically shown as 39, 41, and 43 as are generally known for the collection of hydrocarbons condensed as liquids as at 38, 40, and 42.

Liquids which descend from assembly 30 as indicated by arrows 33, are directed by downwardly sloped lower funnel-like collector plates 44 for collection via discharge pipe 48. After removal from the assembly 30 by scraper 32, the waste materials from which hydrocarbons have been at least partially removed, are dropped on top of removal conveyor 50, moving in a direction indicated by arrow 52. Conveyor 50 transports the materials to drop off its discharge end 51 into waste hopper 54.

Preferably, the entire apparatus may be enclosed as schematically shown by outer sheathing 56 so as to minimize air which may enter the apparatus. The apparatus preferably will be extensively insulated by insulation (not shown) to maintain heat therein and reduce energy consumption. In this regard, feed conveyor 20 and removal conveyor 50 are schematically shown to run parallel to each other relatively close to each other. Such an arrangement is advantageous so that heat from the heated waste materials on removal conveyor 50 may be exchanged in a counter-current fashion to incoming feed materials to pre-heat the feed materials and save energy. The location of the feed bin 24 above scraper 32 assists in this transfer of heat from waste materials to feed materials as would the provision of a long section where conveyors 20 and 50 closely overlie each other.

Figure 2:
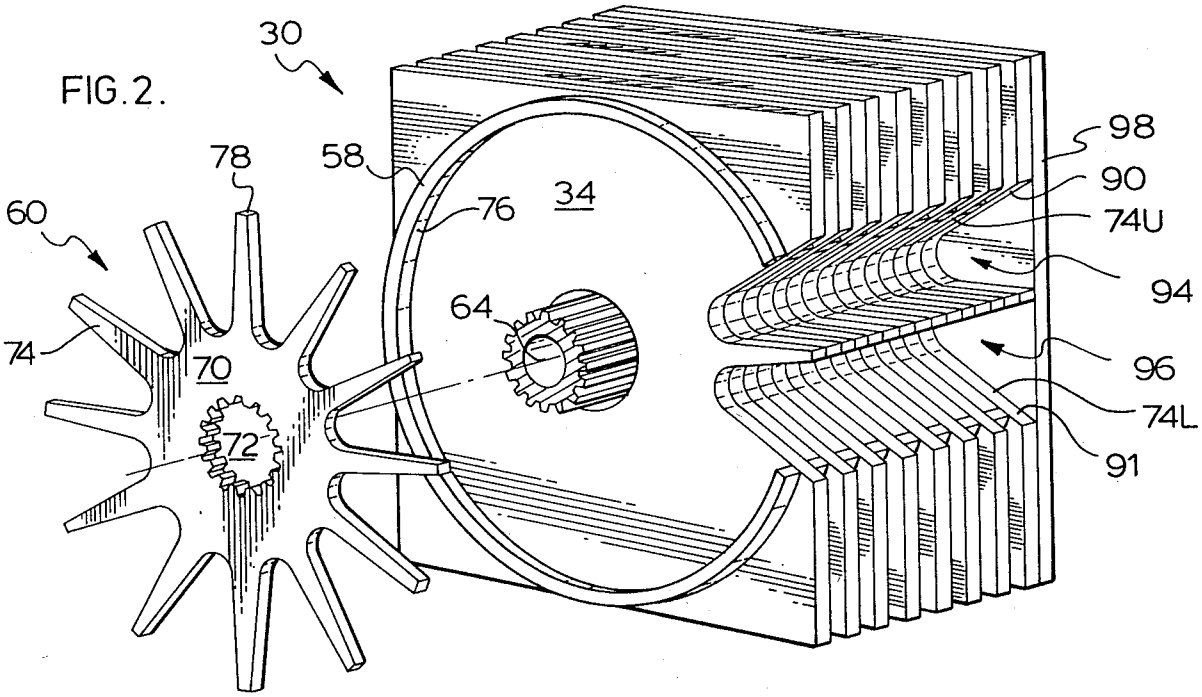
FIG. 2 is a schematic, partially exploded pictorial view of the heater plate and rotor assembly of the apparatus of FIG. 1.
Figure 3:
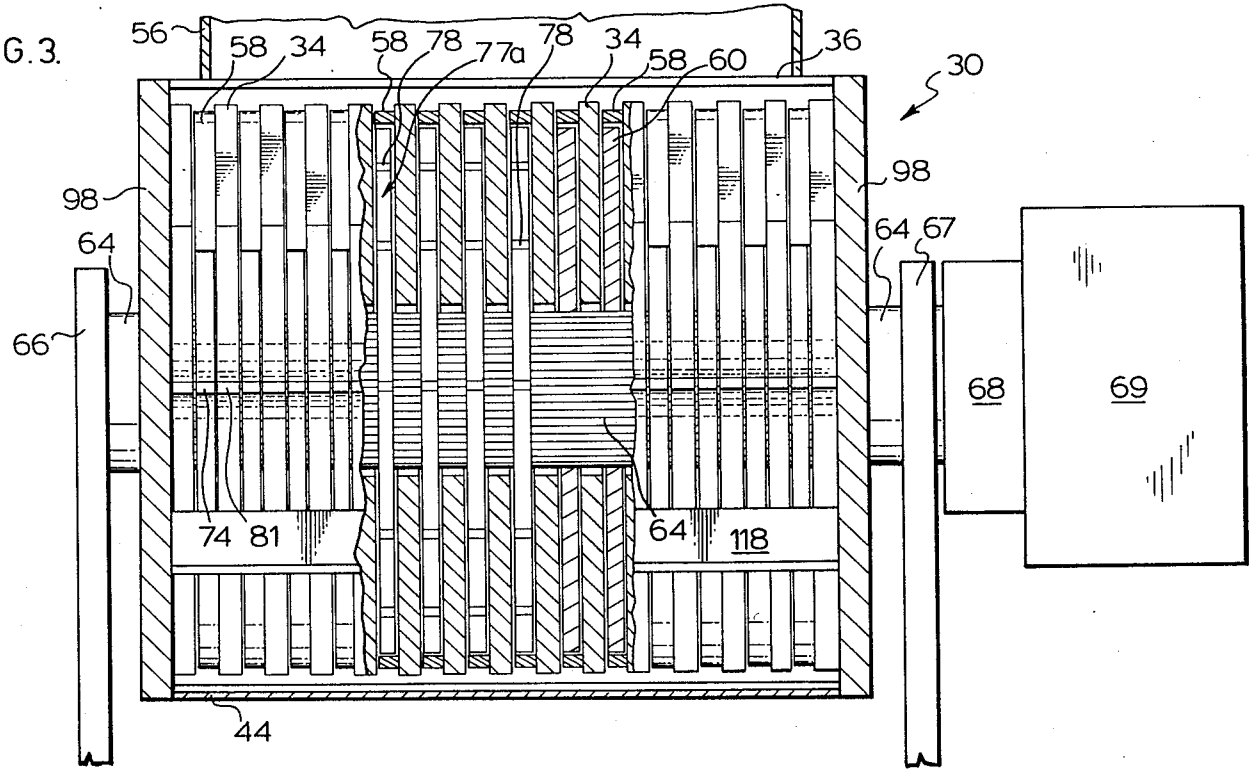
FIG. 3 is a partially cut away and partially sectioned view of the heater plate and rotor assembly shown in FIG. 2.
Figure 7:
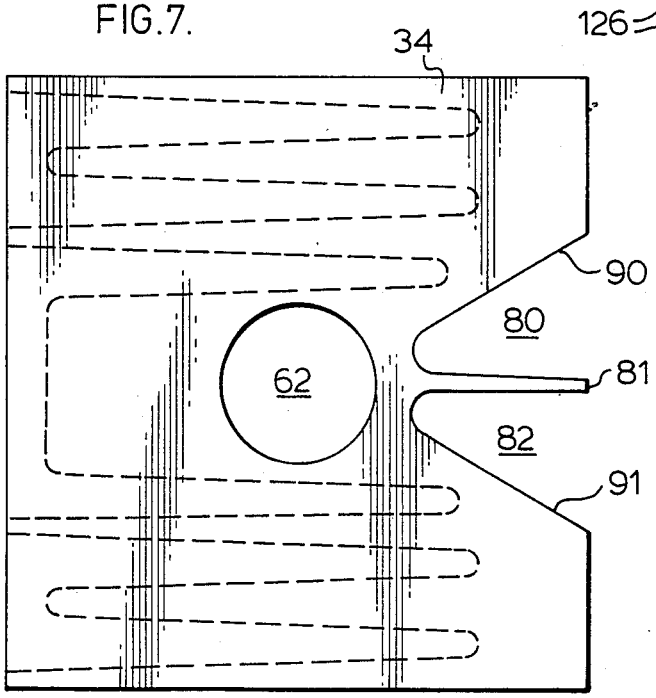
FIG. 7 is a side view of a preferred embodiment of the heater plate shown in FIGS. 1 to 4 and 6.

The structure and operation of heater plate and rotor assembly 30 is now described with particular reference to FIGS. 2, 3 and 7. Assembly 30 comprises a plurality of stationary heater plates 34 with a sand retaining ring 58 and a rotor 60 sandwiched between each two adjacent heater plates 34. Heater plates 34 preferably comprise a number of identical plates of a shape as seen in FIG. 7 with a central circular opening 62 through each. A splined axle 64 extends horizontally freely through the opening 62 of heater plates 34. Axle 64 is supported and journalled outside of assembly 30 by journal supports 66 and 67 as seen in FIG. 3 with one end of axle 64 rotated as desired by gear box 68 and motor 69.

Each rotor 60 has a central hub 70 with a toothed central aperature 72 adapted to engage splined axle 64. Rotors 60 are supported on and rotate with axle 64. The rotors 60 are all identical and each have twelve arms 74 extending radially outwardly from the hub uniformly circumferentially spaced from each other. The rotors are splined onto the hub with their arms in axial alignment.

Retaining ring 58 has a radially inner surface 76 at a diameter but marginally greater than an arc to be described on rotation of ends 78 of arms 74 so that on rotation, ends 78 pass closely adjacent ring 58.

With each rotor 60 sandwiched between two adjacent heater plates 34 with ring 58 about the rotor, a number of sand (material) retaining pockets 77 are defined. Each pocket 77 is defined between each two adjacent arms 74, bordered radially by hub 70 and ring 58 and on each side by the surfaces of adjacent heater plates 34. In this regard, the axial side surfaces of rotors 60 preferably are in sufficiently close relation to side surfaces of heater plates 34 to prevent the sand-sized materials from passing therebetween. Similarly, ends 78 of arms 74 of the rotor are preferably in sufficiently close relation with the inner surface 76 of ring 58 to prevent the sand-sized materials from passing therebetween.

Means must be provided for the hydrocarbon vapours and liquids emanating on heating from the materials to migrate due to gravity and/or expansion upwardly or downwardly from assembly 30 for collection. In this regard, it is preferred to provide spaces between the rotors 60 and plates 34 and similarly between rings 58 and plates 34 sized to be large enough to permit gas and liquid to pass yet not large enough to permit substantial portions of the sand-like material to pass.

Rings 58 may advantageously be secured to abut one heater plate 34 with a small gap provided between the ring 58 and the other adjacent heater plate 34.

Figure 4:
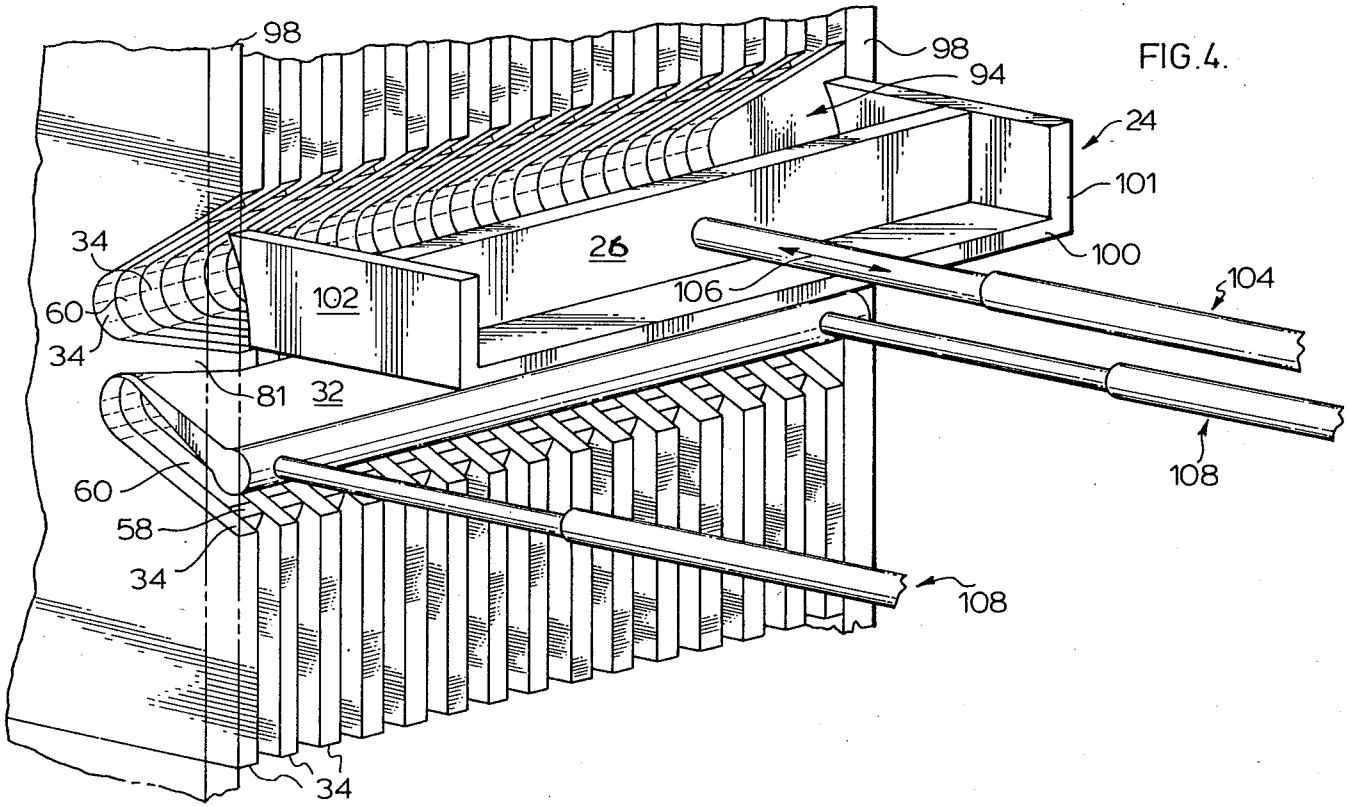
FIG. 4 is a schematic pictorial view of the heater plate and rotor assembly shown in FIGS. 1, 2 and 3, and showing mechanisms for loading and unloading tar sands.

Each heater plate 34 is shown with two wedge-shaped cut-out portions 80 and 82 with a stationary arm 81 therebetween. Stationary arm 81 and cut-out portions 80 and 82 are sized to correspond in size and shape with each arm 74 of rotors 60 and the wedge-shaped spaces between each adjacent arm. With axle 64 rotated to a desired angular position as seen in FIGS. 2 and 4, stationary arm 81 will align with one arm 74 and cut-out portions 80 and 82 will align with the gaps between adjacent other arms 74. In this regard, as seen in FIG. 2, edge surfaces of other arms indicated, 74U and 74L will align respectively with upper edge surface 90 and lower edge surface 91 bordering cut-out portions of each plate 34. In this manner, as seen in FIG. 2, an upper insert opening 94 and a lower removal opening 96 are defined each extending continuously along the entire axial length of the assembly 30 and bounded at their axial ends by solid end plates 98 similarly sized to heater plates 34 but without cut-out portions 80 and 82.

In preferred operation of the apparatus, motor 69 will drive axle 64 in an indexing or stepped manner rotating the axle 64 at timed intervals between positions in which each successive arm 74 is in alignment with stationary arm 81 of stationary heater plates 34. Continuous rotation is possible but less preferred.

With the rotors positions as shown in FIG. 4, with one arm 74 in alignment with stationary arm 81, material may be fed into the assembly by feed ram 26 or removed from the assembly by scraper 32.

Feed ram 26 is schematically illustrated as a shovel-like plate which is in close sliding relation with the bottom and sides 100, 101 and 102 of U-shaped feed bin 24. A hydraulic piston and cylinder device 104 reciprocates feed ram 26 as indicated by arrow 106, as desired, to push material dropped in feed bin 24 into the feed opening 94. With feed opening 94 at least partially filled with material, and feed ram 26 withdrawn, the rotors 60 may be rotated to their next position of alignment of arm 74 with stationary arm 81. In such movement, arms 74, rotating through the feed opening 94, will catch and urge material up between the stationary heater plates 34 and into entrapment within what will become sand retaining pocket 77*a* between the heater plates 34 and adjacent arms 74. About half the material in feed opening 94 will be left behind but this is without disadvantage.

Figure 5:
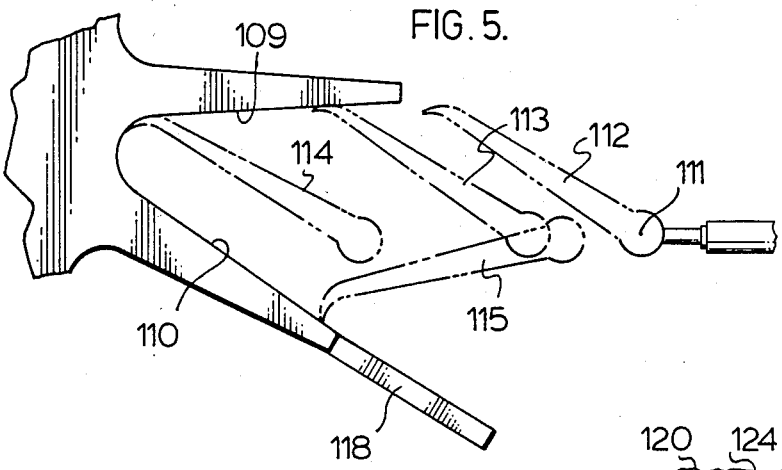
FIG. 5 is a schematic side view of the mechanism for unloading the tar sands.
Figure 6:
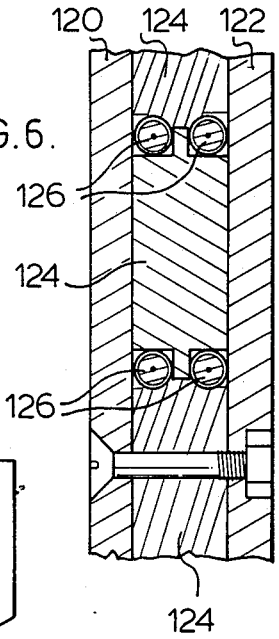
FIG. 6 is an end cross-sectional view showing the construction of a preferred heater plate.

With each successive rotation of the rotors between aligned positions, that is, rotation in steps of 30° for twelve arms, the material caught in each pocket will be rotated by steps until it reaches the lower removal opening 96. Scraper 32 which preferably extends the entire axial length of the assembly 30 between end plates 98 can be reciprocated in and out by cylinder-piston assemblies 108 at the same time as it is pivoted about horizontal axis 111 by pivoting means not shown. The scraper preferably is urged into contact firstly with lower surface 109 of one arm 74, then upper surface 110 of next arm 74 with the scraper assuming positions 112, 113, 114, 115 and then 112 again, in sequence as shown in FIG. 5, as it is reciprocated in and out of the removal opening 96 to scrape and dislodge waste material. The waste material drops due to gravity and is guided by inclined plate 118 (not shown in FIG. 4) onto removal conveyors 50.

It is to be appreciated that preferably feed conveyor 20 is to be operated intermittently so as to drop only a desired quantity of material into feed bin 24 for each feed opening 96 and to not drop material when feed ram 26 is being operated. Gates 14 and 16 can easily be operated to meter appropriate amounts onto feed conveyor 20.

Heater plates 34 preferably are stationary and do not rotate with rotors 60. Making heater plates 34 stationary simplifies their construction. As seen in FIG. 7, heater plates 34 have a number of resistance heater coils disposed therein. One preferred construction is to have each heater plate comprise two outer metal plates 120 and 122 bolted together with wedges 124, which can be urged into place from the top or sides, spacing electrical heater resistance coils 126 therebetween to maintain good physical contact between wedges 124 and coils 126.

Rotors 60 rotate in the direction indicated by arrow 28 in FIG. 1. Rotors 60 thus rotate from feed openlng 94 upwardly away from the feed opening then later downwardly before returning to removal opening 96. This is advantageous in that as the material is initially heated by plates 34, the greatest portion of volatile vapours from the materials may vapourize during heating in the first steps of the rotation of the rotors. This vapour may readily rise from the uppermost sand retaining pockets indicated as *77a* to *77e* in FIG. 1 upward toward upper collector plates 36. Liquids which are extracted from the materials during the middle and later steps of rotation of the rotors may easily drip from the lowermost sand retaining pockets *77f* to *77i* downward toward lower collector plates 44.

Retaining rings 58 have been shown to extend from the feed opening 94 about rotors 60 to removal opening 96. Material in sand retaining pockets *77b* and *77c* has little tendency to be urged radially out of these pockets. Rings 58 need not be provided over the upper portions of the rotor and particularly over pockets *77b* and *77c*. While rings 58 have been shown solid, rings 58 could be provided with a plurality of holes therethrough to permit vapour and liquid to pass through the ring. For example, over the uppermost pockets, the ring could comprise a strip of wire mesh.

To enclose assembly 30, a back plate 128 may be provided as seen in FIG. 1 which joins at its sides with side plates 98 and its top and bottom with collector plates 36 and 44. As seen in FIG. 3, bearing supports 67, gear box 68 and motor 69 are located outside of enclosing side plates 98.

In operation of the apparatus, the feed materials may preferably be pre-heated as by countercurrent heat exchange with waste materials to temperatures preferably not in excess of 110° F. While retained in the retaining pockets, the material is sufficiently heated by heat from the heater plates 34 to thermally drive off vapours and liquids in the material as by thermal cracking and distillation. Heating preferaby is to above 800° F., more preferably to about 900° F. The heater plates preferably are heated to a maximum temperature of about 950° F. The overall residence time of the sand in assembly 30 may be selected having regard to the volume of the pockets 77, the heating capacity of heating plates 34, the nature of the material and the extent to which extraction is desired.

A unit comprising 14 rotors of 66 inches diameter and 2 inches thick with 12 arms per rotor on a tubular drive shaft of 15 inches diameter indexed to rotate between positions every 45 seconds for one revolution every 9 minutes was found to have a capacity of about 136 tons of tar sand per day. With tar sand composition being roughly 10% heavy oil and 90% sand, and assuming 70% vapourization and recovery, representing about 2.5 tons of sand per barrel of oil, the unit produced about 52 barrels of oil a day. The unit had a length between bearing centers of about 65 inches.

The invention has been described with particular reference to removing hydrocarbons from tar sands. The apparatus and method are useful, however, to removing volatile substances from almost any particulate solid materials, for example, the apparatus could be used in extracting volatile spilled wastes from earth and dirt.

In the preferred embodiments, specific individual rings 58 have been shown. If the heater plates are modified to have cylindrical edge surfaces of similar radius to the ends of arms 74, then the heater plates and rotor could be placed inside a horizontally extending cylindrically walled vessel with the cylindrical wall forming the retaining ring and cut-outs provided to access the insert and removal openings.

The preferred embodiment shows two openings, namely, insert opening 94 and removal opening 96. Only one such opening may be provided in which case the feed mechanism and removal mechanism would operate in the one opening, with first removal of waste materials, then insertion of feed materials. This could permit all but one space between the arms being used to retain material being heated, and possibly increase capacity.

The invention has been described and illustrated with reference to a preferred embodiment. Many variations and modifications will now occur to those skilled in the art. For a definition of the invention, reference is made to the appended claims.

WHAT I CLAIM IS:

1. An apparatus for the separation of petroleum bitumen crude from tar sands, oil shales and other oil bearing materials comprising:

a plurality of vertical, parallel, stationary heater plate means disposed side-by-side spaced from one another, a central aperture through the heater plates normal thereto, axle means extending through the central aperture and journalled for rotation about a horizontal axis, drive means to rotate the axle means about said axis, a plurality of similar thin, rotor plate means coupled to the axle means co-axially thereabout for rotation therewith with one rotor plate means sandwiched between each two adjacent heater plate means, each rotor plate means having central hub means about the axle means and a plurality of similar arm means extending radially outwardly from the hub means uniformly circumferentially spaced thereabout, the arm means of all the rotor plate means being in axial alignment, material retaining ring means located about the rotor plate means radially outwardly of an arc defined by the ends of the arm means on rotation of the rotor plate means, a plurality of material retaining pocket means defined for each rotor plate means between:

(i) each two adjacent arm means, (ii) the heater plate means on each side of said rotor plate means, (iii) the hub means, and (iv) the material retaining ring means, each material retaining pocket means moving about the axle means with rotation of the rotor plate means, means to insert material from which crude is to be extracted into each material retaining pocket means when two arms forming each respective material retaining pocket means are at a first relative rotational position with respect to the axle means, and means to remove material from the material retaining pocket means when two arms forming each respective material retaining pocket means are at a relative rotational position with respect to the axle means displaced from said first relative rotational position by at least a major portion of one revolution of the rotor plate means about the axle means.

2. An apparatus as claimed in claim 1 wherein said material retaining ring means comprise a plurality of thin split ring members with one ring member sandwiched between each two adjacent heater plate means, and each ring member extending about at least a major circumferential extent of the rotor plate means.

3. An apparatus as claimed in claim 2, adapted to receive said materials in particulate form of generally sand-size or greater, wherein axial side surfaces of rotor plate means are in sufficiently close proximity to side surfaces of the heater plate means adjacent thereto to prevent substantial portions of said materials of sand-size to pass therebetween.

4. An apparatus as claimed in claim 3 wherein axial side surfaces of the ring members are in sufficiently close proximity to side surfaces of the heater plate means adjacent thereto to prevent substantial portions of said materials of sand-size to pass therebetween.

5. An apparatus as claimed in claim 4 including means to permit vapours and liquids produced by said heater plate means heating said materials in said material retaining pocket means to exit from the material retaining pocket means.

6. An apparatus as claimed in claim 5 wherein said means to permit vapours to exit include gaps between the axial side surfaces of the ring members and the side surfaces of the heater plates sized to permit vapours and liquids to pass therethrough, yet sufficiently small to prevent substantial portions of sand-sized materials to pass therethrough.

7. An apparatus as claimed in claim 6 wherein said heater plate means include electric heater means to heat the heater plate means.

8. An apparatus as claimed in claim 7 including collection means to collect vapours produced by said heater plate means heating said materials.

9. An apparatus as claimed in claim 8 including collection means to collect liquids produced by said heater plate means heating said materials.

10. An apparatus as claimed in claim 9 wherein each heater means has a first cut-out portion open to a lateral edge of the heater plate means and disposed in axial alignment with a space between two adjacent arm means of each rotor plate means when such two arms means are in the first relative rotational position whereby a continuous material insert opening is formed by the alignment of said space of each rotor plate means and the first cut-out portions of the heater plate means, said insert opening open at a lateral edge of the rotor plate means and the heater plate means axially therealong to permit material to be inserted thereinto and whereby on subsequent rotation of the rotor plate means from said first relative position, one of such two arm means of each rotor plate means will urge material in said insert opening between the heater plate means and into a material retaining pocket means formed between such two arm means.

11. An apparatus as claimed in claim 10 including feed means to insert said material into said insert opening.

12. An apparatus for the separation of petroleum bitumen crude from tar sands, oil shales and other oil bearing materials comprising:

a plurality of vertical, parallel, stationary heater plate means disposed side-by-side spaced from one another, a central aperture through the heater plates normal thereto, axle means extending through the central aperture and journalled for rotation about a horizontal axis, drive means to rotate the axle means about said axis, a plurality of similar thin, rotor plate means coupled to the axle means co-axially thereabout for rotation therewith with one rotor plate means sandwiched between each two adjacent heater plate means, each rotor plate means having central hub means about the axle means and a plurality of similar arm means extending radially outwardly from the hub means uniformly circumferentially spaced thereabout, the arm means of all the rotor plate means being in axial alignment, material retaining ring means located about the rotor plate means radially outwardly of an arc defined by the ends of the arm means on rotation of the rotor plate means, a plurality of material retaining pocket means defined for each rotor plate means between:

(i) each two adjacent arm means, (ii) the heater plate means on each side of said rotor plate means, (iii) the hub means, and (iv) the material retaining ring means, each material retaining pocket means moving about the axle means with rotation of the rotor plate means, wherein each heater plate means has a first and a second cut-out portion, each open to a lateral edge of the heater plate means, each heater plate means having an arm-like portion between the first and second cut-out portions and of a size and shape which corresponds axially with that of an arm means on the rotor plate means, wherein with one arm means of each rotor plate means in axial alignment with said arm-like portion (a) the first cut-out portions of the heater plate means are in axial alignment with a space between said one arm means and an adjacent arm means on the same rotor plate means on a first side of the one arm means, forming a material insert opening continuous in axial direction through all rotor plate means and heater plate means, open to a lateral edge thereof and into which material may be inserted; and (b) the second cut-out portions of the heater plate means are in axial alignment with a space between said one arm means and an adjacent arm means on the same rotor plate means on a second side of the one arm means, forming a material removal opening continuous in axial direction through all rotor plates means and heater plate means, open to a lateral edge thereof and via which material therein may be removed, means to insert said material into said material insert opening, and means to remove material from said material removal opening.

13. An apparatus as claimed in claim 12 wherein said drive means includes indexing means to rotate the axle means in stepwise manner to positions in which successive of the arm means of each rotor plate means are in alignment with the arm-like portions on the heater plate means, with the axle means maintained in each position for a similar period of time.

14. An apparatus as claimed in claim 13 wherein the first and second cut-out portions of the heater plate means are positioned so that the space between two adjacent arm means on a rotor plate means is moved on rotation about the axle means from alignment with the first cut-out portion, upwardly and then downwardly before coming into alignment with the second cut-out portion.

15. An apparatus as claimed in claim 13 wherein said means to insert inserts material in a radial direction into said material insert opening, and said means to remove comprises scraper means which moves radially into the material removal opening to engage material contained therein when the axle means is maintained in each position.

16. An apparatus as claimed in claim 15 wherein said material retaining ring means comprise a plurality of thin split ring members with one ring member sandwiched between each two adjacent heater plate means about at least a major circumferential extent of the rotor plate means.

17. An apparatus as claimed in claim 16 including means to permit vapours and liquids produced by said heater plate means heating said materials in said material retaining pocket means to exit from the material retaining pocket means.

18. An apparatus as claimed in claim 17 including collection means to collect vapours produced by said heater plate means heating said materials.

19. An apparatus as claimed in claim 18 including collection means to collect liquids produced by said heater plate means heating said materials.

* * * * *